United States Patent [19]

Horiuchi et al.

[11] 4,401,074

[45] Aug. 30, 1983

[54] IDLING AIR FLOW RATE ADJUSTING DEVICE FOR AN INTERNAL COMBUSTION ENGINE

[75] Inventors: Tomofusa Horiuchi; Shoichiro Yokota, both of Yokohama, Japan

[73] Assignee: Nissan Motor Co., Ltd., Yokohama, Japan

[21] Appl. No.: 285,145

[22] Filed: Jul. 20, 1981

[30] Foreign Application Priority Data

Jul. 22, 1980 [JP] Japan ..... 55/103454[U]

[51] Int. Cl.[3] ..... F02M 23/00

[52] U.S. Cl. ..... 123/339; 123/585; 261/63

[58] Field of Search ..... 123/336, 339, 585; 261/63, 65, DIG. 1; 48/180 A

[56] References Cited

U.S. PATENT DOCUMENTS 1,042,982 10/1912 Sliger ..... 261/65
1,165,224 12/1915 Cadett ..... 261/65
3,669,424 6/1972 Shiobara et al. ..... 261/63

FOREIGN PATENT DOCUMENTS 1361492 4/1964 France ..... 261/63

*Primary Examiner*—William A. Cuchlinski, Jr.
*Attorney, Agent, or Firm*—Lane, Aitken & Kananen

[57] ABSTRACT

An internal combustion engine includes an intake air passage provided with a throttle valve, and an idling air passage by-passing the throttle valve and provided with an idling air flow rate adjusting device which includes a variable orifice. The orifice is formed by a stationary plate with an opening, and a movable plate in contact with and slidably movable with respect to the stationary plate. The two plates consist of this sheet material to prevent accumulation onto the surface of the orifice, of dust and oil particles contained in the intake air. The device further includes an adjusting screw connected to the movable plate to move the same with respect to the stationary plate to thereby adjust the opening degree of the opening in the stationary plate.

6 Claims, 8 Drawing Figures

IDLING AIR FLOW RATE ADJUSTING DEVICE FOR AN INTERNAL COMBUSTION ENGINE

BACKGROUND OF THE INVENTION

1. Field of the Invention

The present invention relates to an idling air flow rate adjusting device for an internal combustion engine.

2. Description of the Prior Art

Such an adjusting device is known which includes a by-pass passage by-passing a throttle valve arranged within an intake air passage, and a variable orifice means within the by-pass passage whose opening determines the idling air flow rate. The orifice means is so adjusted that, when the throttle valve is substantially fully closed, an optimum amount of idling air is supplied to that portion of the intake air passage which is downstream of the throttle valve and then to the engine, thus permitting a stable idling operation of the engine.

In an internal combustion engine, such as an EGI-type engine provided with an electronically controlled gasoline injection valve, or an engine in which liquid propane gas is used as fuel, blow-by gas produced in the engine body is normally recirculated from a crank case to that portion of the intake air passage which is downstream of the throttle valve and of the connection between the intake air passage and the by-pass passage. For this purpose, there is provided a blow-by gas recirculation passage which includes a control valve. When, however, the amount of blow-by gas produced in the engine body exceeds the capacity of the control valve, the excessive amount of the blow-by gas is recirculated through an auxiliary passage to an air cleaner or to that portion of the intake air passage which is upstream of the throttle valve and of the connection between the intake air passage and the by-pass passage. In such a case, the by-pass passage is supplied, besides fresh ambient air, with the blow-by gas.

Conventionally, the above-mentioned variable orifice means in the idling air flow rate adjusting device includes a valve element in the form of an adjusting screw having a tapered free end, and a valve seat therefor which is integral with, or forms part of by-pass passage wall.When the by-pass passage is supplied with the fresh ambient air and the excessive blow-by gas, dust contained in the air which could not be removed by the air cleaner, and oil particles in the blow-by gas tend to gradually accumulate on the surface of the tapered end of the valve element and of the valve seat. Such an accumulation results in reduction of the effective opening area of the orifice and hence, of the idling air flow rate, which is disadvantageous in that, with correspondingly reduced idling revolutional speed of the engine, the operation of the engine becomes unstable, and furthermore in that content of carbon oxide in the exhaust gas increases due to insufficient idling air flow rate for a given amount of fuel.

SUMMARY OF THE INVENTION

Accordingly, it is an object of the present invention to provide an improved idling air flow rate adjusting device which is free from adverse influence of the accumulation of oil particles and dust on the surface of variable orifice means, thus maintaining the adjusted initial opening degree of the variable orifice means for a long time.

Briefly stated, according to the present invention, the variable orifice means comprises a stationary first plate made of thin sheet material which is formed with an opening therein, a second plate also made of thin sheet material which is in contact with, and slidably movable with respect to the first plate to adjust effective cross-sectional area of the opening in the first plate, and an ajusting screw connected to the second plate to drive the same.

With the above arrangement of the present invention, flow of the idling air across the variable orifice means formed by a pair of thin plates effectively prevents accumulation, onto the edges of the plates of oil particles and dust contained in the idling air, so that the adjusted opening degree of the variable orifice means is kept substantially unchanged.

DESCRIPTION OF THE PREFERRED EMBODIMENTS

Figure 1:
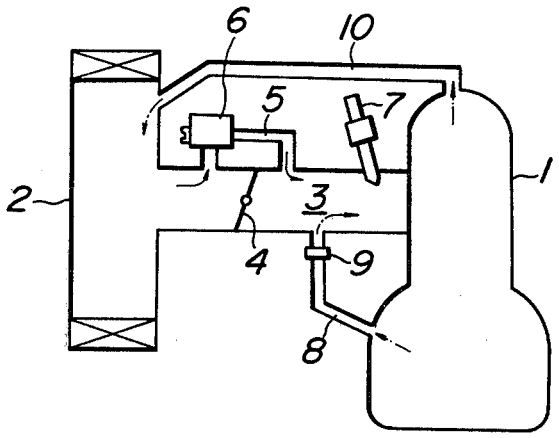
FIG. 1 is a schematic view of an internal combustion engine to which the idling air flow rate adjusting device according to the present invention may be applied.

Referring now to FIG. 1, there is shown an electronically controlled gasoline injection type internal combustion engine, or a so-called EGI type engine, to which the present invention may conveniently be applied. The engine comprises a crank case 1, an air cleaner 2, an intake air passage 3 extending between the air cleaner 2 and a suction manifold of the engine, not shown, a throttle valve 4 arranged within a throttle chamber portion of the intake air passage 3, an idling air passage 5 by-passing the throttle valve 4, a variable orifice 6 forming the device according to the present invention which is inserted into the idling air passage 5 to adjust flow rate of the idling air, and an electronically controlled gasoline injection valve 7 projecting into the intake air passage 3 downstream of the throttle valve 4. The engine further includes a main blow-by gas recirculation passage 8 having therein a control valve 9, which, as shown by dotted lines, supplies the blow-by gas from the crank case 1 to that portion of the intake air passage 3 which is downstream of the throttle valve 4 and of the connection between the intake air passage 3 and the by-pass passage 5. An auxiliary blow-by gas recirculation passage 10 is connected between the crank case 1 and the air cleaner 2 such that when the amount of blow-by gas produced in the crank case exceeds the capacity of the control valve 9 in the main blow-by gas recirculation passage 8, the excessive amount of the blow-by gas is supplied, as shown by dash-dot lines, to the air cleaner 2 through the auxiliary blow-by gas recirculation passage 10.

Figure 2:
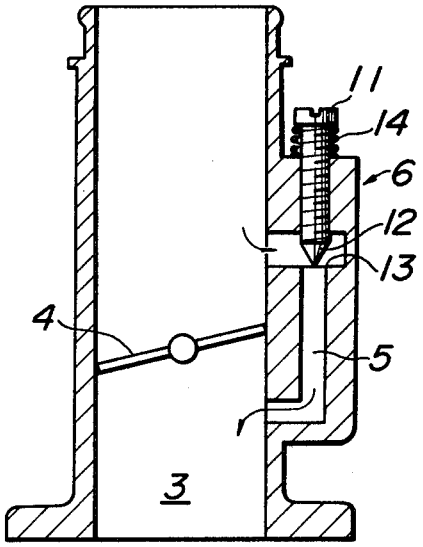
FIG. 2 PRIOR ART
FIG. 2 is a longitudinal sectional view of a conventional idling air flow rate adjusting device.

Conventionally, as shown in FIG. 2, the variable orifice 6 in the idling air by-pass passage 5 includes a valve element in the form of an adjusting screw 11 having a tapered free end 12, and a valve seat 13 which cooperates with the free end 12 of the adjusting screw and which, in this case, is formed by a shoulder portion in the passage 5. A spring 14 prevents loosening of the screw 11. The passage 5 is supplied with idling air containing dust which could not be removed by the air cleaner 2 and oil particles contained in the blow-by gas from the auxiliary recirculation passage 10, and the dust and oil particles tend to gradually accumulate on the surface of the variable orifice 6 to reduce the effective opening area thereof.

Figure 3:
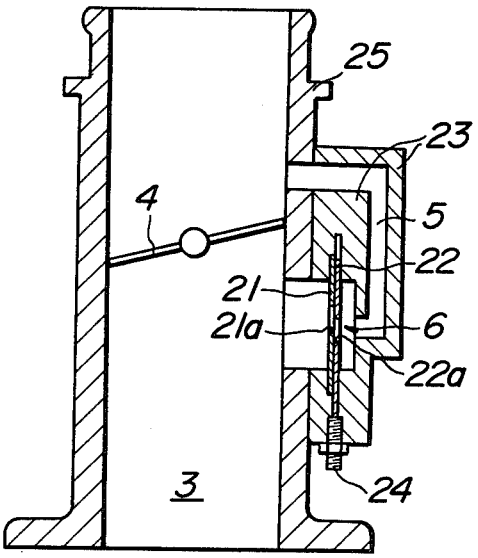
FIG. 3 is a longitudinal sectional view of an idling air flow rate adjusting the device according to one embodiment of the present invention.

According to a first embodiment of the present invention, a shown in FIG. 3, the variable orifice 6 comprises a stationary plate 21 and a movable plate 22. The plates 21, 22 consist of steel sheet having the thickness of about 0.1–0.3 mm, and are formed with openings 21*a*, 22*a*, respectively. The plates 21, 22 are in sliding contact with each other, and mounted in a cover member 23 which forms the idling air by-pass passage 5. An adjusting screw 24 is threaded into the cover member 23 and has an inner end which is connected to the movable plate 22. The screw 24 is used to adjust vertically in FIG. 2 the position of the opening 22*a* of the movable plate 22 with respect to the opening 21*a* of the stationary plate 21, i.e. to adjust the opening degree of the variable orifice 6.

Figure 4:
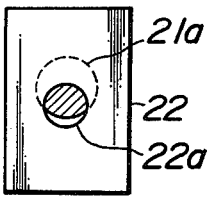
FIG. 4 is a side view of the variable orifice means in the device shown in FIG. 3.
Figure 5:
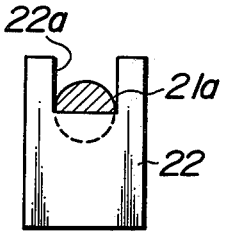
FIG. 5 is a side view of the modification of the variable orifice means in the device shown in FIG. 3.

The openings 21*a*, 22*a* of the two plates 21, 22 may be circular, as shown in FIG. 4. Alternatively, a ciruclar opening 21*a* in the stationary plate 21 may be combined with a square opening or cutout 22*a* in the movable plate 22, as shown in FIG. 5. The effective opening of the variable orifice 6 corresponds to that portion of opening 21*a* in the stationary plate 21 which is not convered by the movable plate 22 or which is kept opened by the opening 22*a*, and is show by hatching lines in FIGS. 4 and 5.

In the above-mentioned embodiments, since the variable orifice comprises two thin plates 21, 21, accumulation of dust and oil particles in the intake air onto the peripheries of the openings 21*a*, 22*a* of the plates 21, 22 can be positively prevented by the idling air flow across the variable orifice. Even a small amount of dust and oil particles which tend to form an accumulated layer on the surface of the variable orifice can easily be separated from the surface by the idling air flow. By this, an initially adjusted optimum opening degree of the variable orifice can be kept substantially unchanged for a long time so that re-adjustment or maintainance of the idling speed of the engine becomes unnecessary. Consequently, an undesired increase in carbon oxide content in the exhaust gas or unstable engine operation during the idling condition, resulting from a decrease in the idling air which could not be avoided in the conventional arrangement, can be effectively prevented by the variable orifice according to the present invention.

Preferably, the cover member 23 is secured to the side wall of the throttle chamber portion 25 of the intake air passage 3 with a seal member (not shown). e.g. an O-ring therebetween. The movable plate 22 may be urged by a spring such that the plate 22 is moved by the adjusting screw 24 against the force of the spring.

Figure 6:
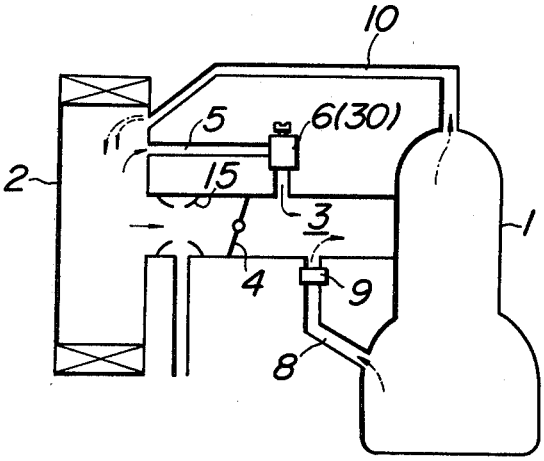
FIG. 6 is a schematic view of another type of an internal combustion engine to which the device according to the present invention may also be applied.

FIG. 6 shows another type of an internal combustion engine using liquid propane gas (LPG) as fuel, to which also the present invention may be applied. Reference numerals used in FIG. 1 denote the same or corresponding parts which, therefore, are not explained. The engine shown in FIG. 6 has a venturi 15 having an opening from which the fuel is introduced into the intake air passage 3. The idling air by-pass passage 5 is relatively long since it is connected between the air cleaner 2 and that portion of the intake air passage 3 which is downstream of the throttle valve 4.

Figure 7:
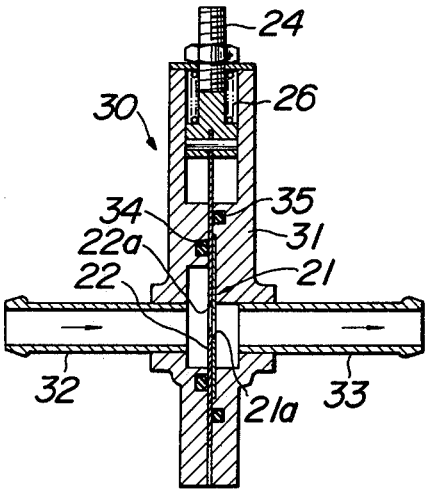
FIG. 7 is a longitudinal sectional view of the device according to another embodiment of the present invention which may suitably be used in the engine shown in FIG. 6.
Figure 8:
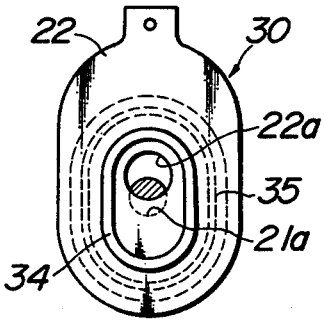
FIG. 8 is a side view of the variable orifice means in the device shown in FIG. 7.

A second embodiment of the present invention shown in FIGS. 7 and 8 can suitably be used in the engine shown in FIG. 6, in which a variable orifice in the idling air flowrate adjusting device is formed as an independent unitary assembly 30. More particularly, the assembly 30 includes a casing 31 which is separated from the throttle chamber portion of the intake air passage 3, and which is provided with socket portions 32, 33 forming the inlet and outlet of the variable orifice, respectively. The socket portions 32, 33 serve to connect the variable orifice with appropriate locations of the idling air by-pass passage 5. In this embodiment also, the variable orifice is formed by respective stationary and movable thin plates 21, 22 each having an opening 21*a*, 22*a*. The movable plate 22 on its upper end is connected with an adjusting screw 24 and is moved by the screw 24 against the force of a spring 26. The movable plate 22 is sealed by O-rings 34, 35 on both sides thereof.

The operation of the variable orifice as well as the manner of adjusting the opening degree thereof are substantially the same as those explained with reference to the first embodiment. The variable orifice assembly 30 according to the second embodiment is particularly advantageous, since modification of the throttle chamber portion of the intake air passage is not necessary.

From the forgoing description, it will be appreciated that the idling air flow rate adjusting device according to the present invention is substantially maintainance-free over a long period, and is simple in construction and can be manufactured easily and economically. Whilst the present invention has thus far been explained with reference to specific embodiments, the present invention is not limited thereto and, in fact, various modifications may be made without departing from the scope of the present invention. For example, the opening in the stationary and/or movable plate may be a slit, or such an opening may be formed in the stationary plate only. In the latter case, the opening in the stationary plate is closed or opened by the edge of the movable plate.

What is claimed is:

1. An idling air flow rate adjusting device for adjusting the flow rate of idling air in an internal combustion engine of a type which includes an intake air passage, a throttle valve in said intake air passage, and an idling air passage by-passing the throttle valve, said adjusting device being located in the idling air passage and comprising:

variable orifice means comprising a stationary first plate and a movable second plate, each being made of a sheet of material which is sufficiently thin to cause dust and oil particles in the idling air passage which might accumulate on an orifice-defining surface of said variable orifice means to be separated therefrom by the idling air flow in said idling air passage whereby adjustments of said variable orifice means are less frequently necessary, each of said stationary first plate and said movable second plate defining an opening therein, said movable second plate being in contact with and slidably movable relative to said stationary first plate and so positioned that the openings of each of said plates normally have at least a portion thereof in register to define a variable, effective cross-sectional area of the opening in the stationary first plate; and an adjusting member cooperating with said movable plate to move said movable plate relative to said stationary plate to vary the effective cross-sectional area of the opening in the first plate and thereby vary the idling air flow rate in said passage.

2. The device as claimed in claim 1, wherein the variable orifice means is arranged within a cover member which is secured to a side wall of a throttle chamber portion in the intake air passage.

3. The device as claimed in claim 1, wherein the variable orifice means is arranged within a casing having on its inlet and outlet sides socket portions for connection with the idling air passage.

4. The device as claimed in claim 1, wherein the thickness of the thin sheet material of each of said stationary first plate and said movable second plate is in the range of about 0.1 to about 0.3 mm, whereby accumulation of dust and oil particles in the intake air onto the peripheries of the opening in each plate is prevented by the idling air flow across the variable orifice defined by the relative locations of the respective openings in the plates.

5. The device as claimed in claim 1 wherein the adjusting member is an adjusting screw.

6. The device as claimed in claim 5, further comprising a spring which urges the second plate such that the second plate is moved by the adjusting screw against the force of the spring.

* * * * *